US011059083B2

(12) United States Patent
Arvedi

(10) Patent No.: US 11,059,083 B2
(45) Date of Patent: Jul. 13, 2021

(54) MILL ROLLS CAPABLE OF ROLLING LONG KILOMETERS FOR ESP PRODUCTION LINE

(71) Applicant: Arvedi Steel Engineering S.p.A., Cremona (IT)

(72) Inventor: Giovanni Arvedi, Cremona (IT)

(73) Assignee: ARVEDI STEEL ENGINEERING S.P.A.

( * ) Notice: Subject to any disclaimer, the term of this patent is extended or adjusted under 35 U.S.C. 154(b) by 215 days.

(21) Appl. No.: 16/308,836

(22) PCT Filed: Jun. 13, 2017

(86) PCT No.: PCT/CN2017/088053
§ 371 (c)(1),
(2) Date: Dec. 11, 2018

(87) PCT Pub. No.: WO2017/215595
PCT Pub. Date: Dec. 21, 2017

(65) Prior Publication Data

US 2019/0308232 A1 Oct. 10, 2019

(30) Foreign Application Priority Data

Jun. 15, 2016 (CN) ..... 201620572000.3

(51) Int. Cl.
*B21B 27/02* (2006.01)
*B21B 1/46* (2006.01)

(52) U.S. Cl.
CPC ..... *B21B 1/463* (2013.01); *B21B 27/02* (2013.01); *B21B 27/021* (2013.01); *B21B 2267/02* (2013.01); *B21B 2267/18* (2013.01)

(58) Field of Classification Search
CPC ..... B21B 1/463; B21B 27/02; B21B 27/021; B21B 2027/022; B21B 2203/18; B21B 2267/02; B21B 2267/18; B21B 2267/24
See application file for complete search history.

(56) References Cited

U.S. PATENT DOCUMENTS 3,948,072 A * 4/1976 Aramaki ..... B21B 31/04 72/225
4,864,836 A * 9/1989 Ochiai ..... B21B 37/42 72/11.7

(Continued)

FOREIGN PATENT DOCUMENTS

CN 201015778 Y 2/2008
CN 101987326 A 3/2011

(Continued)

OTHER PUBLICATIONS

Russian Federation Office Action, dated Dec. 18, 2019, issued in corresponding Russian Federation Patent Application No. 2018144296/02(073846). English translation. Total 19 pages.

(Continued)

*Primary Examiner* — Shelley M Self
*Assistant Examiner* — Jared O Brown
(74) *Attorney, Agent, or Firm* — Ostrolenk Faber LLP

(57) ABSTRACT

Mill rolls capable of rolling long kilometers used for ESP production line and a method for rolling long kilometers using the mill rolls. The mill rolls include rolls (3, 4), a bearing box (2) and a roll shifting hydraulic cylinder (1), wherein the middle portion of the surface of the roll sinks inwards, one end of the rolls is frustum-shaped, smaller and smaller outwards, so that the roll surface forms a compensation ramp, and the other end of the rolls is cylindrical. The upper roll (3) and the lower roll (4) have the same roll profile and are positioned in the opposite direction. The mill rolls (Continued)

are characterized by reduced runaway of the rolled product and a longer service life.

19 Claims, 4 Drawing Sheets

(56) References Cited

U.S. PATENT DOCUMENTS

| | | | | | |
|---|---|---|---|---|---|
| 5,714,692 | A * | 2/1998 | Rohde | B21B 37/38 | 73/862.55 |
| 6,295,851 | B1 * | 10/2001 | Sjostrom | B21B 37/58 | 72/10.1 |
| 6,324,881 | B1 * | 12/2001 | Benedetti | B21B 13/142 | 72/247 |
| 2013/0192790 | A1 | 8/2013 | Eckerstorfer et al. | 164/455 | |
| 2013/0228082 | A1 * | 9/2013 | Honjou | H01M 4/0435 | 100/176 |
| 2016/0101450 | A1 | 4/2016 | Linzer et al. | 72/201 | |

FOREIGN PATENT DOCUMENTS

| | | | | | |
|---|---|---|---|---|---|
| CN | 102688889 | A | 9/2012 | | |
| CN | 102886385 | A | 1/2013 | | |
| CN | 103203370 | A | 7/2013 | | |
| CN | 203330115 | U | 12/2013 | | |
| CN | 205659983 | U | 10/2016 | | |
| EP | 0276743 | A1 | 8/1988 | | |
| EP | 0153849 | B1 * | 1/1992 | B21B 31/18 | |
| EP | 1228818 | A2 | 8/2002 | | |
| EP | 1228818 | A3 | 8/2002 | | |
| EP | 2139622 | B1 | 10/2012 | | |
| JP | S 59-1006 | | 1/1984 | | |
| JP | S 60-82211 | A | 5/1985 | | |
| JP | S61-186108 | A | 8/1986 | | |
| JP | S 62-6806 | A | 1/1987 | | |
| JP | S 62-68611 | A | 3/1987 | | |
| JP | 03000406 | A * | 1/1991 | B21B 37/28 | |
| JP | H 3-406 | A | 1/1991 | | |
| JP | 06198313 | A * | 7/1994 | B21B 27/02 | |
| JP | H 06-198313 | A | 7/1994 | | |
| JP | 20000-15308 | A | 1/2000 | | |
| JP | 2004-098074 | A | 4/2004 | | |
| JP | 2013-226572 | A | 11/2013 | | |
| RU | 2268795 | C2 | 1/2006 | | |
| RU | 2476280 | C1 | 2/2013 | | |
| RU | 2484908 | C2 | 6/2013 | | |
| SU | 929262 | A1 * | 5/1982 | B21B 38/00 | |
| WO | WO 2017/215595 | A1 | 12/2017 | | |

OTHER PUBLICATIONS

International Search Report dated Sep. 15, 2017 in corresponding PCT International Application No. PCT/CN2017/088053.

Written Opinion dated Sep. 15, 2017 in corresponding PCT International Application No. PCT/CN2017/088053.

Office Action dated Jan. 27, 2020 issued in corresponding Japanese Patent Application No. 2018-565721 with English translation.

Indian Office Action, dated Jul. 3, 2020, issued in corresponding Indian Patent Application No. 201817042968. Total 7 pages.

Extended European Search Report, dated Jan. 8, 2020, issued in corresponding European Patent Application No. 17812706.4. Total 6 pages.

* cited by examiner

MILL ROLLS CAPABLE OF ROLLING LONG KILOMETERS FOR ESP PRODUCTION LINE

CROSS-REFERENCE TO RELATED APPLICATIONS

The present application is a 35 U.S.C. §§ 371 national phase conversion of PCT/CN2017/088053, filed Jun. 13, 2017, which claims priority of Chinese Patent Application No. 201620572000.3, filed Jun. 15, 2016, the contents of which are incorporated by reference herein. The PCT International Application was published in the English language.

TECHNICAL FIELD

The present invention relates to mill rolls, in particular to mill rolls capable of rolling long kilometers suitable to be used in an ESP production line, and a method for rolling long kilometers comprising the mill rolls.

BACKGROUND ART

ESP endless strip steel production lines have achieved a rigid connection between the continuous casting machine and the rolling line, thereby eliminating steel scrap loss caused by frequent threading-in and -out as in conventional hot continuous rolling. By doing so, the ESP production process and ESP production lines realize a stable rolling process, particularly for thin gauge products.

In general, the economic benefits of thin gauge products are greater than those of thick gauge products. The greatest advantage of ESP is the good capability for rolling thin gauge products at high mass flow. The ESP rolling process features a transition form that is 'thick-thin-thick', i.e. after the start-up of the ESP line, the final rolled product is rather thick, thereafter the gauge of the final rolled product becomes thinner and thinner, and before the end of the uninterrupted rolling campaign, the gauge of the final rolled product becomes thicker again. The core of improving the thin gauge proportion lies in increasing the rolling kilometers, which means the increase of continuous casting tonnage of the casting machines and the reduction of roll wear. Continuous casting tonnage is limited by the service life of casting nozzles, and roll wear is limited by the guaranteed requirements of the rolled product. Currently, the service life of the nozzles used in ESP continuous casting falls into a bearable range, and roll contact and the runaway of the rolled product due to roll wear are keys to limit the rolling kilometers, which is going to be solved by an optimized roll profile according to the invention.

Currently, the roll profile of the mill rolls is mainly cosine concave which feature larger partial wear when performing long-kilometer rolling. Due to wear, contact (a.k.a. box holes or roll kissing) between the rolls, in particular between the edges of the rolls, can happen easily. Thus, smooth rolling and geometric properties of the rolled product can no longer be guaranteed. Consequently, the rolling kilometers of mill rolls according to the prior art is less than or equal to 80 km.

SUMMARY OF INVENTION

A technology task of the present invention is to provide mill rolls which are capable of rolling long kilometers and may be used in an ESP production line, with the purpose of overcoming the above shortages of the prior art technology.

The invention solves this technical problem by: mill rolls capable of rolling long kilometers used in an ESP production line, comprising rolls, a bearing box at each end of each roll and a roll axial shifting device, particularly a roll and a horizontal shifting device, which may be a hydraulic cylinder. The rolls comprise a first and a second roll, which may be an upper roll and a lower roll below the upper roll. Both ends of each roll are connected with a bearing box, respectively. One end of each of the rolls is connected with the roll axial shifting device, the middle portion of the surface of the rolls sinks radially inwards, and one end of the rolls is frustum-shaped, progressively smaller axially outwards. The other end of the rolls is cylindrical. The first, e.g. upper roll and the second, e.g. lower roll have the same roll profile and are positioned in the opposite direction.

Each end of each roll is connected to a respective bearing box for rotatably mounting the respective roll in the mill stand. Each roll features a first end which is frustum-shaped, a middle portion having a concave shape, and a second end with a cylindrical shape. The first, e.g. upper roll is positioned in an opposite direction to the second, e.g. lower roll, i.e. if the first, e.g. upper roll features a frustum-shaped end on the left hand end, a concave middle part and a cylindrical end on the right hand side, the lower, e.g., second roll arranged in the same mill stand consequently features a cylindrical end on the left hand end, a concave middle part and a frustum-shaped end on the right hand side. Of course, also an inverse arrangement is possible. One end of each roll is connected to a roll axial shifting device, here for example, a roll shifting hydraulic cylinder, for shifting the roll in an axial typically horizontal direction. The roll shifting hydraulic cylinders typically are long stroke cylinders, having a stroke between 300 and 600 mm. By shifting the upper roll in an axial direction (e.g. from left to right) by the roll axial shifting device, typically a hydraulic cylinder connected to the upper roll and by shifting the lower roll in the opposite axially typically horizontal direction (e.g. from right to left) by the roll axial shifting devices also typically a hydraulic cylinder connected to the lower roll, the maximum kilometers of the mill rolls can keep up uninterrupted operation increases from some 80 km to 150 km. Thereby, maintenance costs for re-grinding the rolls are reduced, yield is increased due to fewer sequence starts, and the output of thin gauge rolled product is increased.

The roll profile curve of the middle portion of the roll surface sinking radially inwards is a cosine curve or a polynomial roll profile curve. In particular the polynomial roll profile curve is a parabolic curve.

The slope of the frustum is defined as the ratio between the radial extension R of the frustum and the length L of the frustum. The slope of the frustum corresponds to the ratio between the wear $\Delta r$ of the roll and the roll shifting value s (see FIG. 2 for definition of slope).

The slope of the frustum is preferably not more than 0.01.

Advantageously, the bearing boxes for the upper roll, preferably both the bearing boxes for the upper roll and for the lower roll, are connected to roll radial adjusting devices, typically radial adjusting hydraulic cylinders for adjusting the roll in a radial, typically vertical direction. Alternatively to roll adjusting hydraulic cylinders, electric drives (e.g. screw drives) can be used. Thereby the roll gap between the upper and the lower roll can be kept constant despite the wear of the rolls.

According to an advantageous embodiment of the invention, a thickness gauge for measuring the thickness of the rolled product is connected to a controller. The controller determines a thickness error e, that is the difference between a target value of the thickness of the rolled product and the measured thickness of the rolled product. The controller is connected to the roll shifting hydraulic cylinders for shifting the upper roll and the lower roll in opposite axial, typically horizontal directions in accordance with the thickness error. During endless production, the radial, typically positions of the upper and lower rolls remain generally constant. Therefore, the thickness error e, which may be determined continuously or discontinuously during rolling, corresponds to the sum of the radial wear of the upper and lower rolls. The rolls are shifted in opposite horizontal directions as a function of the thickness error e. As an alternative to or in addition to determining the thickness error e, a wear monitor for determining the wear Δr of the upper roll and the lower roll during rolling can be used. The wear monitor takes into account rolling parameters such as rolling force, rolling speed, rolling time, material of the rolling stock etc. The wear monitor is connected to a controller and the controller is connected to the roll axial shifting hydraulic cylinders for shifting the upper roll and the lower roll in opposite axial directions as a function of the wear Δr.

In order to keep the thickness of the rolled product constant during rolling, the controller is connected to roll radial adjusting devices, typically hydraulic cylinders, for the upper roll for adjusting the upper roll in a radial direction in accordance with at least one of the thickness error e and the wear Δr.

In order to keep both the thickness and the pass-line of the rolled product constant during rolling, the controller is connected to the roll radial adjusting devices or hydraulic cylinders (or electric drives) for the lower roll for adjusting the lower roll in a radial direction in accordance with the thickness error e and the wear Δr.

A further technological task of the invention is to provide an advantageous method for rolling long kilometers comprising the mill rolls according to the invention. By utilising the method, not just the time that the rolls can be kept in continuous operation is improved, but also the geometric shape, particularly the crown, of the rolled product remains good during rolling long kilometers.

This is achieved by the following method steps: In order to compensate for wear of an upper roll and a lower roll, the upper roll is shifted in a first axial, typically horizontal direction a distance corresponding to the roll shifting value by a roll axial shifting device, typically a hydraulic cylinder, connected with the upper roll, and the lower roll is shifted in a second horizontal direction for the said distance by an axial, shifting device, a shifting hydraulic cylinder, connected with the lower roll, wherein the first axial direction is opposite to the second axial direction. By shifting the upper roll and the lower roll in opposite axial directions during rolling, the mill rolls can be utilized for a much longer time in the rolling mill and the mill rolls can roll many more kilometers. Also, the shape of the rolled product does not deteriorate during rolling.

During rolling, it is advantageous when the distances that the upper roll and the lower roll are shifted is increasing over time in a steady or an unsteady manner. In other words, neither the upper roll nor the lower roll are oscillating in an axial direction, since the rolls are shifted in one direction only such that the distance the rolls are shifted is typically increasing over time. The increase can be done steadily, i.e. without interruption, or unsteadily, i.e. where the increase is temporarily stopped.

In order to compensate thickness changes due to the wear of the rolls, it is beneficial to lower the upper roll in a radial direction by roll radial adjusting devices, typically hydraulic cylinders.

In case the radial or vertical position of the lower roll is kept constant, it is preferable to radially lower the upper roll, typically vertically by a distance that corresponds to the sum of the wear in the radial direction of both the upper roll and the lower roll. By doing so, the thickness of the rolled product can be maintained despite the wear of the rolls.

In case the vertical positions of the upper roll and the lower roll can be changed during rolling, it is preferable that the upper roll is lowered radially by a distance that corresponds to the wear of the upper roll in the radial direction, and that the lower roll is raised radially, typically vertically by a distance that corresponds to the wear of the lower roll in the radial direction. By doing so, the so-called "pass line" of the rolled product is kept constant.

In case the material of the upper roll is identical to the material of the lower roll, it is preferable that the distance that the upper roll is moved radially or lowered corresponds to the distance that the lower roll is moved radially or raised.

During rolling, it is preferable to shift the upper roll in the first axial direction a distance corresponding to the roll shifting value by means of the roll axial shifting device, typically the hydraulic cylinder connected with the upper roll. The upper roll is instead lowered radially by roll radial devices, here adjusting hydraulic cylinders, in a radial, vertical direction. It is also preferable to shift the lower roll in the second axial direction by the same distance by means of the roll axial shifting hydraulic device of cylinder connected with the lower roll, and the lower roll is raised in the radial direction by roll radial adjusting hydraulic cylinders, whereas the distance the upper roll is lowered radially corresponds to the distance the lower roll is raised radially. By doing this, the thickness and the pass line of the rolled product remain constant, despite the wear of the rolls.

In general, it is beneficial to set the maximum shifting distance of the upper roll and of the lower roll in a range between 300 mm and 600 mm. Once the rolls are shifted over the maximum shifting distance or even before that, the rolls will be exchanged.

In order to allow proper roll axial shifting during rolling, it is advantageous to measure the thickness of the rolled product during rolling and to calculate the thickness error e, that is the difference between the target value of the thickness of the rolled product and the measured thickness of the rolled product, during rolling, and the upper roll and the lower roll are shifted in opposite axial directions as a function of the thickness error e.

As an alternative to calculating the thickness error, it is advantageous to determine the wear Δr of the upper roll and the lower roll during rolling, taking into account rolling parameters including rolling force, temperature, e.g. of the rolls, the rolled product etc., rolling speed, material of the rolling stock and of the rolls etc., and the upper roll and the lower roll are shifted in opposite axial directions as a function of the wear Δr.

It is beneficial to shift the upper roll and lower roll by a roll shifting value s, wherein $$s = \frac{\Delta r * L}{R},$$

wherein L is the length of the frustum-shaped end of the rolls, R is the radial extension of the frustum-shaped end of the rolls, and Δr is the wear.

Compared with the prior art technology, the present invention has the following prominent beneficial effects:

1. Edge contact is avoided to guarantee thin gauge long-kilometer rolling.
2. Runaway of rolled product is reduced, thereby ensuring good quality of the final product.
3. Good geometric shape of the rolled product.
4. The thickness of the rolled product and the pass line can be kept constant during the rolling campaign.

BRIEF DESCRIPTION OF DRAWINGS

FIGS. 6A, 6B and 6C show the method steps for rolling long kilometers using the mill rolls according to the invention, wherein FIG. 6A shows for a first variant, an initial situation before rolling; FIG. 6B shows a second situation after rolling; and FIG. 6C shows a third situation after more rolling.

FIGS. 7A, 7B and 7C show a first alternative to the respective method steps of FIG. 6 for rolling long kilometers according to the invention.

FIGS. 8A, 8B and 8C show a second alternative to the respective method steps of FIG. 6 for rolling long kilometers according to the invention.

DESCRIPTION OF EMBODIMENTS

The present invention is further described in detail in combination with the accompanying drawings and embodiments as below.

As was noted above, the first and second rolls are typically one above the other and are oriented so that their axes are horizontal. They are shifted horizontally or in the planes of the axes. The mill rolls are also adjustable radially, typically vertically.

Figure 1:
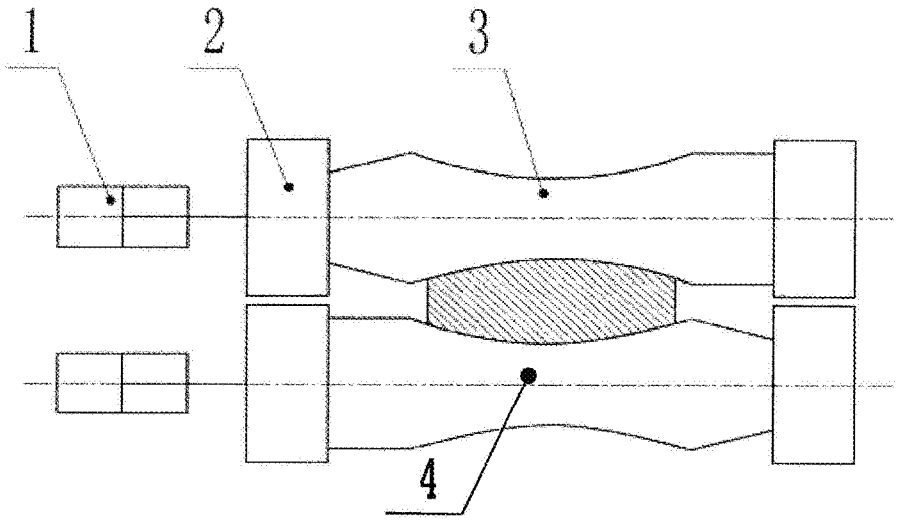
FIG. 1 is a diagram showing the structure of mill rolls according to the invention.

As shown in FIG. 1, the present invention comprises first, typically upper rolls 3 and second, typically lower rolls 4, bearing boxes 2 located on both ends of the rolls 3 and 4, and two roll axial shifting hydraulic cylinders 1, wherein the rolls comprise an upper roll 3 and a lower roll 4. Both ends of the rolls are connected with the bearing box 2, respectively. One end of each roll is connected with a respective one of the roll axial shifting hydraulic cylinders 1. Under the action of the respective hydraulic cylinders 1, the rolls 3,4 perform axial roll shifting in opposite axial, typically horizontal directions.

Figure 2:
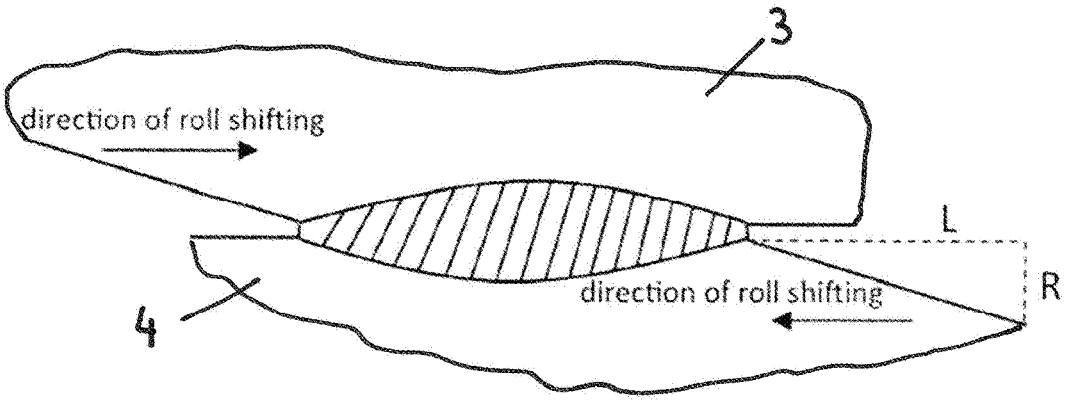
FIG. 2 is a diagram showing the profiles of a first and second, typically an upper and a lower roll according to the invention.

As shown in FIGS. 1 and 2, the middle portion of the surface of each roll 3, 4 sinks radially inward to form a sunken section. In an optimized design, the roll profile curve of the roll surface of the sunken section is a cosine curve or a polynomial roll profile curve. One axial end region of each of the rolls 3, 4 is frustum-shaped, gradually of smaller diameter in an axially outward direction, so that the roll surface forms a compensation ramp. The slope of the frustum ramp is preferably not more than 0.01. The slope of the frustum as defined by R/L corresponds to the ratio between the wear Δr and the roll shifting distance s. According to a preferred embodiment of the invention, $R/L \leq 0.01$. The other axial end region of each roll is cylindrical, i.e. the diameter of the section is identical everywhere in the axial direction.

The upper roll 3 and the lower roll 4 have the same roll profile. The rolls are positioned in respective opposite axial directions. This design allows the compensation of wear of the rolls. The asymmetric design with a cylinder at one end of each roll and a frustum at the other end has the following advantages: When roll shifting is not matched with the wear of the rolls, runaway of rolled product can be reduced to some extent by means of gravity and plane support. Moreover, after the occurrence of wear, secondary turning or grinding of the rolls can be performed on the cylindrical section to increase the service life and applicable surface of the rolls.

As shown in FIG. 2, the roll shifting adopts the form of opposite axial, typically horizontal shifting, namely, the rolls move in opposite axial or horizontal directions from the conical end to the cylindrical end. The direction the rolls are shifted is indicated by arrows.

Figure 3:
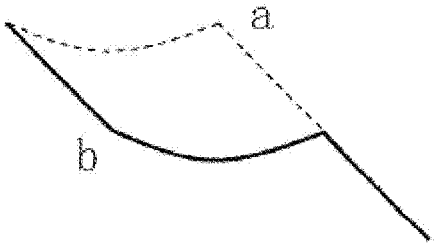
FIG. 3 is a diagram showing a shape of a lower roll before and after wear according to the invention.

The lower roll is an example. The wear form is shown as FIG. 3. A dashed line a is a curve position before wear and a solid line b is a curve position after wear.

Figure 4:
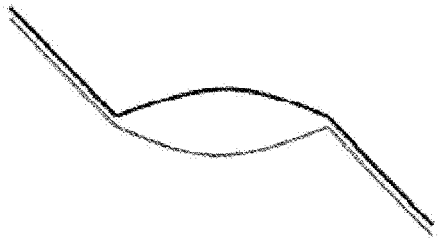
FIG. 4 is a diagram showing the shapes of an upper and a lower roll after wear according to the invention.

After the upper roll 3 and lower rolls 4 are positioned together, their relationship is shown in FIG. 4. When wear Δr occurs to the mill rolls in the radial direction, the steel strip edges remain in the state of being close to the conical section via transverse radial shifting of the mill rolls, and there is no contact risk between the upper and lower rolls. The distance s the rolls are radially shifted is given by the relation $s=\Delta r*L/R$.

Figure 5:
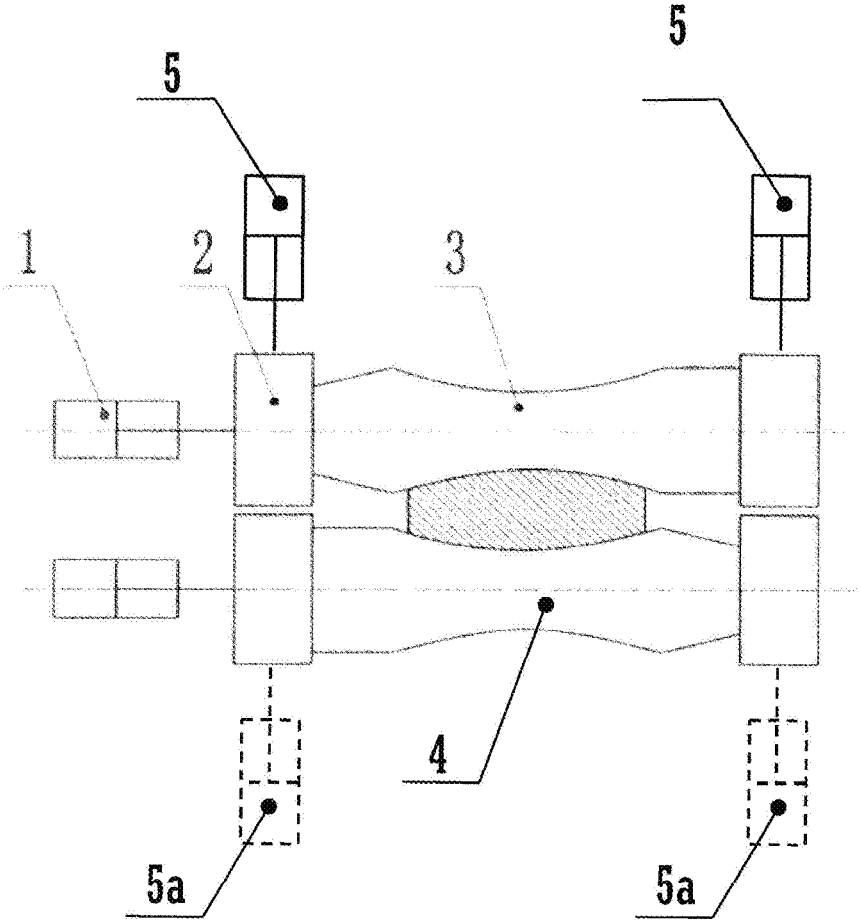
FIG. 5 is a diagram showing an alternative structure to FIG. 1 of mill rolls according to the invention.

In FIG. 5, alternative mill rolls according to the invention are depicted. In addition to the parts present in FIG. 1, the radial, typically vertical position of the upper roll 3 can be adjusted by roll radial devices, typically hydraulic adjustment cylinders 5. By doing so, the thickness of the rolled product can be kept constant even in case of worn out upper and lower rolls 3, 4. Optionally, also the radially, typically vertical position of the lower roll 4 can be adjusted by a pair of roll radial devices, typically hydraulic adjustment cylinders 5*a*; the optional elements are depicted by dashed lines. By the combination of the roll radial hydraulic adjustment cylinders 5 arranged above the upper roll 3 and the roll radial hydraulic adjustment cylinders 5*a* arranged below the lower roll 4. Not just the thickness of the rolled product, but also the pass line of the rolled product can be kept constant during rolling.

Figure 9:
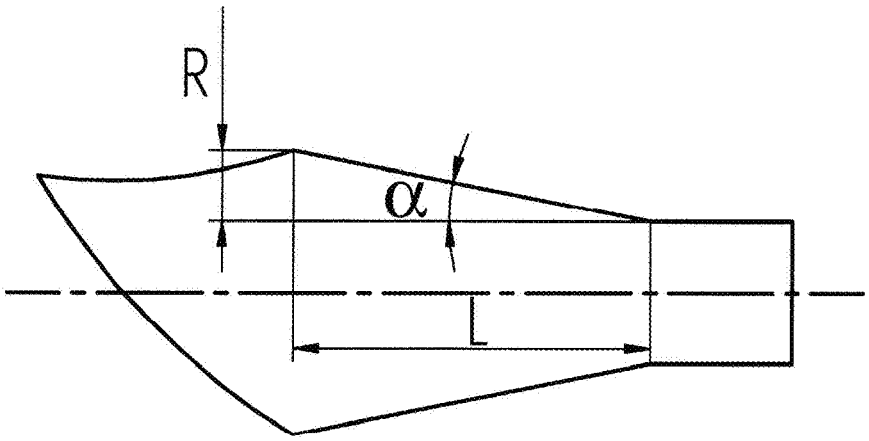
FIG. 9 shows the profile of the frustum-shaped end of a roll according to the invention.
Figures 6A, 6B, 6C, 7A, 7B, 7C, 8A, 8B, 8C:
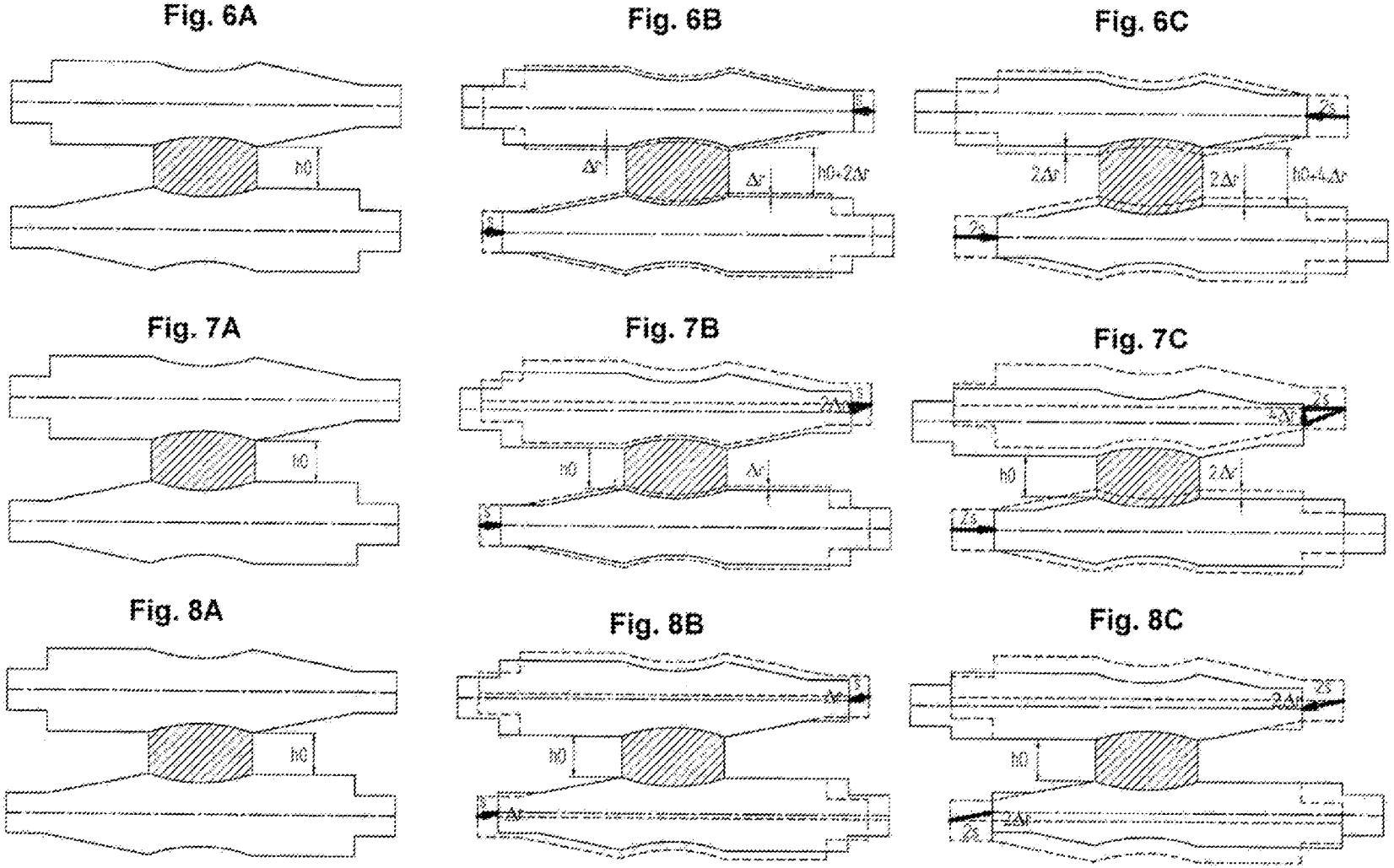

In FIGS. 6A, 6B and 6C, a first variant of the method for rolling long kilometers using the mill rolls according to the invention is depicted schematically. The left picture FIG. 6A shows the initial situation, wherein a rolling stock is rolled by the upper and lower roll to thickness h0. The middle picture FIG. 6B depicts the situation after some time of rolling, wherein the radius of both the upper roll and the lower roll is reduced by Δr due to wear. The wear Δr is determined by a wear monitor, taking into account rolling parameters including rolling force, rolling speed, rolling time, and the material of the rolling stock. Without changing the vertical position of the upper and lower rolls, the thickness of the rolled product would increase to h0+2*Δr due to wear. In order to continue the rolling of a rolled product having a crowned shape, both the upper roll and the lower rolls are axially shifted by a distance $$s = \frac{\Delta r * L}{R},$$

wherein L is the length of the frustum and R is the radial extension of the frustum as depicted in FIG. 9. The upper roll is shifted axially, typically horizontally from right to left, whereas the lower roll is shifted in the opposite direction, from left to right. The right picture FIG. 6C depicts the situation after a longer time of rolling, wherein the radius of each of the upper roll and the lower roll is reduced by 2*Δr due to wear. Due to that, the thickness of the rolled product would increase to h0+4*Δr. The wear Δr is again determined. In order to continue the rolling of a rolled product having a crowned shape, both the upper roll and the lower roll are axially shifted by a distance 2*s*. The advantage of the method according to FIGS. 6A, 6B and 6C is its simplicity and rolling can be continued for long rolling distances.

In FIGS. 7A, 7B and 7C, a second variant of the method for rolling long kilometers using the mill rolls according to the invention is depicted schematically. The left picture shows the initial situation, as depicted in the left picture of FIG. 6A. The middle picture FIG. 7B depicts the situation after some time of rolling, wherein the radius of each of the upper roll and the lower rolls is each reduced by Δr due to wear. The wear Δr is again determined by a wear monitor. Without changing the radial, typically vertical positions of the upper and lower roll, the thickness would increase to h0+2*Δr due to wear. In order to continue the rolling of a rolled product having a crowned shape, both the upper roll $$s = \frac{\Delta r * L}{R},$$

and the lower roll are shifted by an axial distance and the upper roll is lowered radially, typically vertically by the distance 2*Δr. By doing this, the thickness of the rolled product remains at h0. The right picture 7C depicts the situation after a longer time of rolling, wherein the radius of each of the upper roll and the lower roll is reduced by 2*Δr due to wear. Due to that and without any change of the radial or vertical positions of the upper and lower rolls, the thickness of the rolled product will have increased to h0+2*Δr due to wear. The wear Δr is again determined and in order to continue the rolling of a rolled product having a crowned shape, each of the upper roll and the lower roll is shifted by an axial distance 2*s*, and the upper roll is lowered further in the radial or vertical direction by the additional 2*Δr, making it 4*Δr against the initial radial or vertical position depicted in the left picture FIG. 7A. The advantage of the method according to FIGS. 7A, 7B and 7C is that rolling can be continued for long distances and even the thickness of the rolled product can be kept constant at h0. In FIGS. 7A, 7B, 7C, the radial or the vertical position of the lower roll remains constant.

In FIGS. 8A, 8B and 8C, a third variant of the method for rolling long kilometers using the mill rolls according to the invention is depicted schematically. The left picture FIG. 8A shows the initial situation, as depicted in the left picture FIG. 6A. The middle picture FIG. 8*b* depicts the situation after some time of rolling, wherein the radius of each of the upper roll and the lower roll is reduced by Δr due to wear. The wear Δr is again determined by a wear monitor. In order to continue the rolling of a rolled product having a crowned shape, both the upper roll and the lower roll are shifted by an axial distance $$s = \frac{\Delta r * L}{R},$$

the upper roll is lowered radially, or vertically by the distance Δr and the lower roll is raised radially or vertically by the distance Δr. Doing so causes the thickness of the rolled product to remain at h0 and the so-called pass line of the rolled product remains constant. The right picture FIG. 8C depicts the situation after a longer time of rolling, wherein the radius of each of the upper roll and the lower roll is reduced by 2*Δr due to wear. The wear Δr of the rolls in the radial direction is again determined. In order to continue the rolling of a rolled product having a crowned shape, both the upper roll and the lower roll are shifted by an axial or horizontal distance 2*s*, the upper roll is lowered further in the radial or vertical direction by the additional distance Δr, making it 2*Δr against the vertical position depicted in the left picture FIG. 8A, and the lower roll is raised further in the radial or vertical direction by the additional distance Δr, making it 2*Δr against the vertical position depicted in the left picture FIG. 8A. The advantage of the method according to FIGS. 8A, 8B and 8C is that rolling can be continued for long distances, the thickness of the rolled product can be kept constant at h0, and even the pass line of the rolled product remains constant.

In FIGS. 6, 7 and 8, the profile of the rolls without wear, without axial or horizontal roll shifting and without radial or vertical roll adjusting is depicted by dashed lines.

In FIG. 9 the geometry of a frustum-shaped end of a roll is depicted, including the length L of the frustum in the axial direction, the radial extension R of the frustum, and the angle α, wherein $$\tan(\alpha) = \frac{R}{L}.$$

Figure 10:
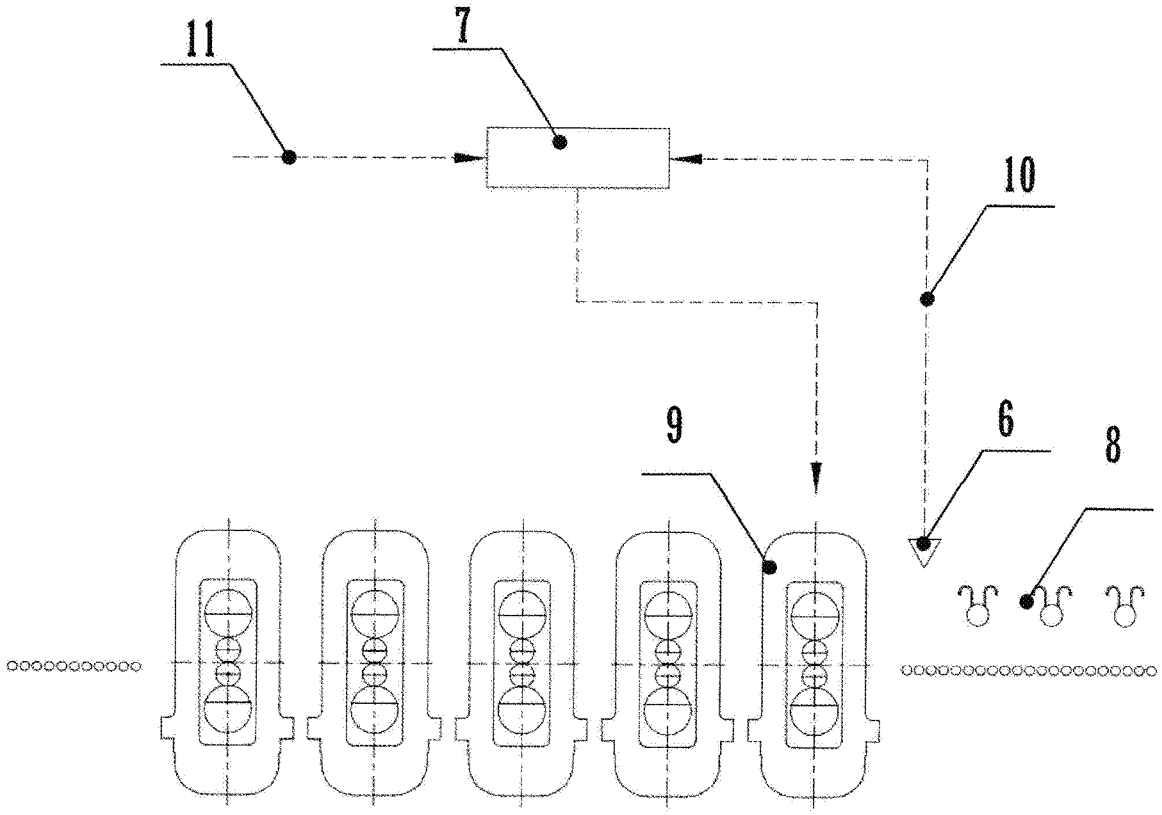
FIG. 10 is a schematic diagram showing the structure of mill rolls in an ESP line according to the invention.

FIG. 10 shows a layout of a finishing mill of an ESP line with five rolling stands 9 each including the invention disclosed herein. After the finishing mill, a cooling section with cooling headers 8 for laminar cooling of the rolled products is installed. Between the exit of the last mill stand 9 of the finishing mill and the first cooling header 8 of the cooling line, a thickness measurement device 6 for measuring the thickness of the rolled product is installed. A measurement signal 10 corresponding to the thickness is transmitted to the controller 7. The controller 7 calculates the thickness error e, that is the difference between a target thickness 11 of the rolled product and the thickness of the rolled product measured by the thickness measurement device. The controller 7 transmits a signal corresponding to the thickness error e to the rolling stand 9, and then both the upper roll and the lower roll of the mill stand are shifted in opposite horizontal directions depending on the thickness error e. The embodiment of FIG. 10 shows performance of the method according to the invention on a single roll stand only. The invention is, however, not limited to a single roll stand and can be applied to multiple roll stands also, e.g. to three last roll stands before the cooling section.

Figure 11:
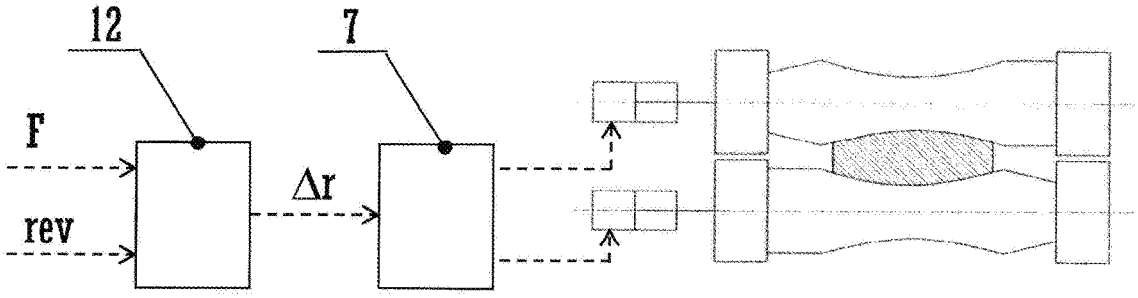
FIG. 11 is a schematic diagram showing the function of a wear monitor according to the invention.

FIG. 11 shows the function of a wear monitor 12 in combination with hydraulic shifting cylinders for axially shifting the upper roll and the lower roll. The rolling force F, the rotational speed rev of the upper and lower rolls or the number of rotations $\int_0^t$ rev(t)dt of the rolls, are continuously fed into a wear monitor 12. Using these input signals, the wear monitor 12 continuously calculates the wear Δr of the upper and lower roll. Depending on the wear Δr, the controller 7 outputs a signal to the roll axial hydraulic shifting cylinder connected to the upper roll and to the roll axial hydraulic shifting cylinder connected to the lower roll. According to these signal, both rolls are shifted in opposite axial or horizontal directions the same distance.

The present invention can compensate the wear of mill rolls, thereby extending the rolling kilometer of the rolls, so as to realize above 150 km rolling, while guaranteeing a proper geometry of the rolled product and the thickness profile in the width direction of strip steel.

It is noted that specific embodiments of the present invention have been described the invention in detail; as for technicians or engineers in the field, various apparent changes made without departing from the essence and scope of the present invention shall fall into the protection scope of the present invention.

REFERENCE SIGNS LIST

1 Roll axial shifting hydraulic cylinder
2 Bearing box
3 Upper roll
4 Lower roll
5 Roll radial adjusting cylinder for upper roll
5*a* Roll radial adjusting cylinder for lower roll
6 Thickness gauge
7 Controller
8 Cooling header
9 Mill stand
10 Measured value
11 Target value
12 Wear monitor
α Slope angle of frustum
e Thickness error
L Length of frustum
R Radial extension of frustum
Δr Wear in radial direction
s Roll shifting value

The invention claimed is:

1. Rolling mill capable of rolling kilometers of a rolled product in a production line, the rolling mill comprising:

a first roll and a second roll oriented parallel to each other, each of the first and second rolls being rotatable around a respective roll axis, and including a respective roll surface positioned to roll the rolled product between the first and second rolls and to thereby define a shape for the rolled product;

rotation bearings at opposite ends of each of the first and second rolls; and roll axial shifting devices connected each to a respective one of the first and second rolls in a position to enable each of the first and second rolls to rotate around the respective roll axis, the roll axial shifting devices being configured and operable to shift the first and the second rolls each roll in opposite axial directions by roll shifting value (s) in accordance to a radial wear (Δr) of the first and second rolls;

wherein each of the first and second rolls comprises a middle surface portion sinking radially inwardly in shape;

wherein one end of each of the first and second rolls is frustum-shaped, of smaller radius axially outward on said roll while the other end of each of the first and second rolls is cylindrical;

wherein the first and second rolls each have a same roll profile over their length and are positioned respectively such that the ends of the first and second rolls face in opposite directions; and wherein said roll shifting value(s) is equal to said radial wear (Δr) of the first and second rolls divided by a slope of said frustrum-shaped end of each of the first and second rolls.

2. The rolling mill of claim 1, wherein a roll profile of the middle surface portion of each of the first and second rolls sinks radially inward and is curved in a cosine curve or a polynomial roll profile curve.

3. The rolling mill of claim 2, wherein the polynomial roll profile curve is a parabolic curve.

4. The rolling mill of claim 1, wherein the slope of the frustrum-shaped end of each of the first and second rolls is not more than 0.01.

5. The rolling mill of claim 1, wherein the rotation bearing for at least one of the rolls is connected to a respective roll radial shifting device and each roll radial shifting device is configured for adjusting the respective roll in radial directions.

6. The rolling mill according to claim 5, wherein the roll radial shifting devices are hydraulic cylinders.

7. The rolling mill according to claim 1, wherein the first roll is an upper roll and the second roll is positioned as a lower roll below the first roll.

8. The rolling mill according to claim 1, wherein the roll axial shifting devices are hydraulic cylinders.

9. A method for rolling kilometers of rolled product using the rolling mill according to claim 1, the method comprising:

rolling the rolled product;

to compensate a radial wear (Δr) of the first roll and the second roll, shifting the first roll in a first axial direction by a distance corresponding to a roll shifting value(s) by means of the roll axial shifting device connected with the first roll; and shifting the second roll in a second axial direction by a same distance corresponding to said roll shifting value (s) by means of the roll axial shifting device connected with the second roll, wherein the first axial direction is opposite to the second axial direction, and wherein said roll shifting value(s) is equal to Δr*L/R, wherein L is a length of the frustum-shaped end of each of the first and second rolls, R is a radial extension of the frustum-shaped end of each of the first and second rolls, and Δr is the radial wear of the first and second rolls.

10. The method according to claim 9, further comprising lowering the first roll in a radial direction by a roll radial shifting device.

11. The method according to claim 10, further comprising lowering the first roll by a distance that corresponds to the radial wear (Δr) of the first roll; and raising the second roll by a distance that corresponds to the radial wear (Δr) of the second roll.

12. The method according to claim 11, wherein the distance over which the first roll is lowered corresponds to the distance over which the second roll is raised.

13. The method according to claim 10, further comprising lowering the first roll in the radial direction by a distance that corresponds to a sum of the radial wear (Δr) of both of the first roll and the second roll, while a radial position of the second roll is kept constant.

14. The method according to claim 9, wherein during the rolling, the axial distance that the first roll and the second roll are shifted is increased over time in a steady or an unsteady manner.

15. The method according to claim 9, wherein:

the first roll is also lowered by respective roll radial shifting devices in a radial direction, and the second roll is also raised in the radial direction by respective roll radial shifting devices, wherein the distance that the first roll is lowered radially corresponds to the distance that the second roll is raised radially.

16. The method according to claim 9, wherein a maximum axial shifting distance of the first roll and the second roll is between 300 mm and 600 mm.

17. A method for rolling kilometers of rolled product using the rolling mill according to claim 1, the method comprising:

rolling the rolled product;

to compensate a radial wear (Δr) of the first roll and the second roll, shifting the first roll in a first axial direction by a distance corresponding to a roll shifting value(s) by means of the roll axial shifting device connected with the first roll;

shifting the second roll in a second axial direction by a distance corresponding to said roll shifting value(s) by means of the roll axial shifting device connected with the second roll, wherein the first axial direction is opposite to the second axial direction;

lowering the first roll by a distance that corresponds to the radial wear (Δr) of the first roll; and raising the second roll by a distance that corresponds to the radial wear (Δr) of the second roll.

18. The method according to claim 17, wherein the distance over which the first roll is lowered corresponds to the distance over which the second roll is raised.

19. A method for rolling kilometers of rolled product using the rolling mill according to claim 1, the method comprising:

rolling the rolled product;

to compensate a radial wear (Δr) of the first roll and the second roll, shifting the first roll in a first axial direction by a distance corresponding to a roll shifting value(s) by means of the roll axial shifting device connected with the first roll;

shifting the second roll in a second axial direction by a distance corresponding to said roll shifting value(s) by means of the roll axial shifting device connected with the second roll, wherein the first axial direction is opposite to the second axial direction; and lowering the first roll in a radial direction by a distance that corresponds to a sum of the radial wear (Δr) of both of the first roll and the second roll, while a radial position of the second roll is kept constant.

* * * * *